US005088654A

United States Patent [19]

Cielker

[11] Patent Number: 5,088,654

[45] Date of Patent: Feb. 18, 1992

[54] EQUIPMENT FOR LIFTING (AND LOWERING) A CABLE DRUM

[75] Inventor: Werner Cielker, Birgel, Fed. Rep. of Germany

[73] Assignee: Katimex-Cielker GmbH, Fed. Rep. of Germany

[21] Appl. No.: 530,761

[22] Filed: May 30, 1990

[30] Foreign Application Priority Data

Jun. 9, 1989 [EP] European Pat. Off. ..... 89110434.1

[51] Int. Cl.[5] ..... B65H 16/06

[52] U.S. Cl. ..... 242/85; 242/54 R

[58] Field of Search ..... 242/85, 58.6, 79, 729.51, 242/54 R; 212/203, 204; 248/157; 254/266, 93 R, 93 H, DIG. 1, 134, 2 R, 329; 259/26 B

[56] References Cited

U.S. PATENT DOCUMENTS

| | | | |
|---|---|---|---|
| 1,732,175 | 10/1929 | Thompson | 254/134 |
| 1,836,815 | 12/1931 | Reeves | 242/85 |
| 2,652,207 | 9/1953 | Goedken | 242/58.6 |
| 3,165,295 | 1/1965 | Nolden | 254/93 R |
| 3,275,298 | 9/1966 | Hand | 254/45 |
| 3,702,139 | 11/1972 | Chaffin | 254/2 R X |
| 3,831,877 | 8/1974 | Bennett et al. | 242/86.5 R |
| 3,944,094 | 3/1976 | Compton | 414/458 |
| 4,148,399 | 4/1979 | Carter et al. | 414/732 |
| 4,177,978 | 12/1979 | Warsaw | 254/2 R X |
| 4,447,012 | 5/1984 | Woodruff | 242/54 R |
| 4,679,743 | 7/1987 | Dallmaier | 242/129.51 X |
| 4,684,310 | 8/1987 | Stange | 254/134 X |

FOREIGN PATENT DOCUMENTS

| | | | |
|---|---|---|---|
| 539185 | 4/1957 | Canada | 254/DIG. 1 |
| 678669 | 7/1939 | Fed. Rep. of Germany | 254/134 |
| 876556 | 10/1951 | Fed. Rep. of Germany . | |
| 1961378 | 12/1969 | Fed. Rep. of Germany . | |
| 1342266 | 9/1963 | France | 212/203 |
| 2067477 | 11/1969 | France . | |
| 698396 | 11/1965 | Italy | 212/203 |

OTHER PUBLICATIONS

"Cable Winding Systems Hydraulic Drum Jacks", Auto Reel.

"High-Lift Jack Handles Farm Jobs," C. F. Marley.

*Primary Examiner*—Daniel P. Stodola

*Assistant Examiner*—John P. Darling

*Attorney, Agent, or Firm*—Diller, Ramik & Wight

[57] ABSTRACT

A mechanism for lifting or lowering a cable drum which includes a stand located at lateral end faces of a cable drum which is adapted to be raised and lowered. Each stand includes a foot and a pair of vertical posts carrying upper and lower crossbeams with each lower crossbeam carrying a hydraulic hoist. The lower crossbeam is selectively secured to the posts, a pin carried by each upper crossbeam is inserted into a journal of the cable drum, and each hydraulic hoist is actuated to raise each upper crossbeam and its associated pin thereby raising the cable drum.

16 Claims, 2 Drawing Sheets

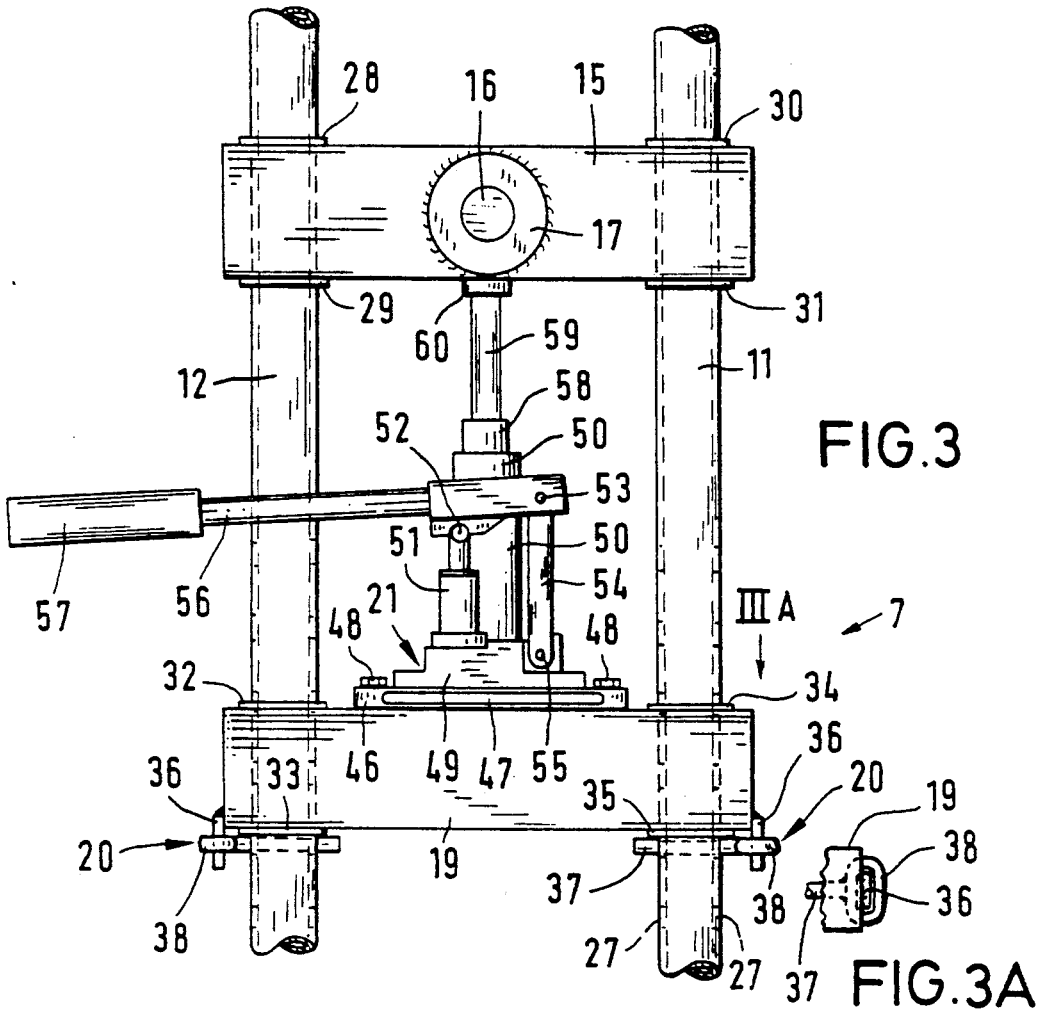
FIG.3
FIG.3A
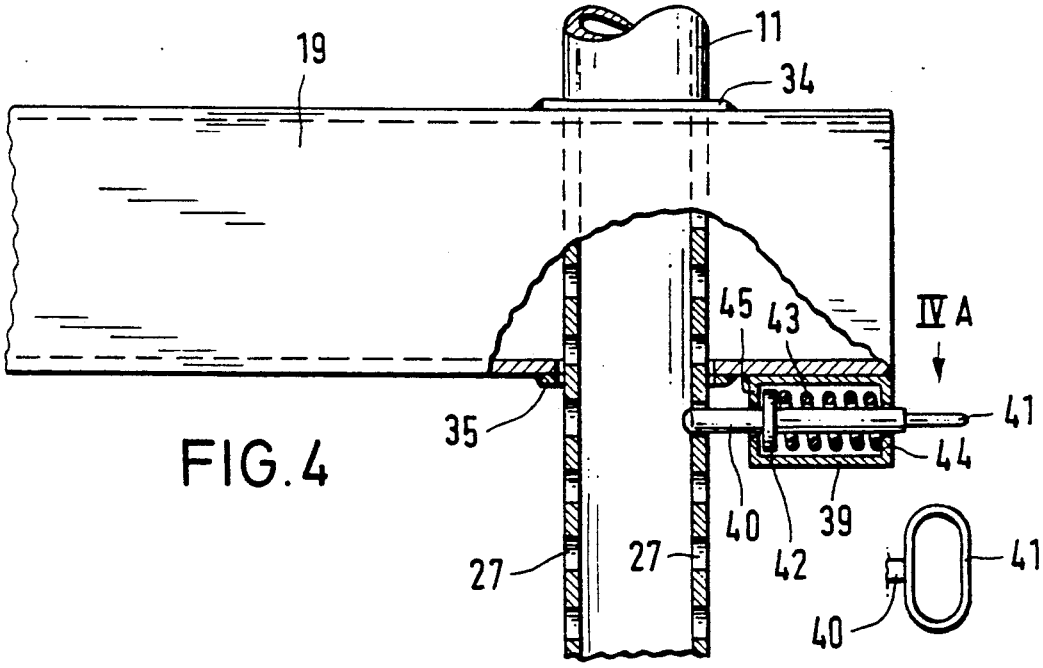
FIG.4
FIG.4A

EQUIPMENT FOR LIFTING (AND LOWERING) A CABLE DRUM

The present invention relates to equipment for lifting (and lowering) a cable drum. The phrase "cable drum" covers generally conventional cable drum assemblies which comprise a shaft, a drum or hub and two lateral circular flanges. A cable of a kilometer or more in length is wound on the hub between the two lateral circular flanges. Instead of cable, any other rope, strand or material of indeterminate length may be wound on the hub or drum, for instance a traction-resistant plastic cord which is used to pull cables into empty cable tubes or pipes. As a general rule, cable drums are very heavy and together with the cable wound upon the hubs thereof may weigh several thousand kilograms. Such cable drums must be lifted off the ground or a similar supporting surface to wind the cable on or off. Much of the time specialized motor vehicles are used for the latter purposes, as well as to convey the cable drum to and from a particular location. Such specialized vehicles are most often required because of the great weight of the cable drums per se and, of course, the added weight of the wound cable thereon. Such special vehicles are equipped on their loading or carrying beds with gripper arms operable to load and unload the cable drum relative to the vehicle bed. The gripper arms can also move the cable drum to an arbitrary position at which the drum may be rotated and the cable can be wound on or off. Such special vehicles, however, are expensive to manufacture. Moreover, cable laying, as a rule, does not permit long vehicle set-up time. Accordingly, though such special vehicles have been conventionally provided for the purpose of lifting, lowering and manipulating cable drums, they are expensive both from the standpoint of manufacture and from the standpoint of utilization.

SUMMARY OF THE INVENTION

In keeping with the foregoing, it is an object of the present invention to provide equipment for lifting (and lowering) a cable drum which is economical, compact and can be easily handled, utilized and transported.

The conventional problems earlier noted are solved by the present invention through a mechanism which includes one stand on each side of the two flanges of a conventional cable drum which is to be lifted (or lowered). Each stand includes a foot and a pair of posts rising therefrom which carry two vertically spaced height-adjustable crossbeams. Each upper crossbeam carries a journal which is housed in a hollow shaft of the cable drum. Each lower crossbeam is equipped with an adjustment and snap-in system for selectively locating each lower crossbeam relative to its associated posts. A hydraulic hoist is mounted between the two crossbeams at each side of the cable drum and when actuated will lift (or lower) the upper crossbeam and the cable drum carried thereby relative to the lower crossbeam.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 3 is a fragmentary enlarged portion of the mechanism of FIG. 1, and illustrates a pair of vertical posts, upper and lower crossbars associated therewith, an adjustment and snap-in system associated with the lower crossbar, and a hydraulic hoist between the crossbars.

FIG. 3A is a fragmentary top view taken generally along line III A of FIG. 3, and illustrates the manner in which a pin of the adjustment and snap-in system is retained in a selected position of adjustment relative to its associated post.

FIG. 4 is an enlarged elevational view of another lower crossbar and post, and illustrates another adjustment and snap-in system thereof.

FIG. 4A is a top view taken generally along line IV A of FIG. 4, and illustrates a handle associated with a locking detent of the adjustment and snap-in system.

DESCRIPTION OF THE PREFERRED EMBODIMENTS

Figure 1:
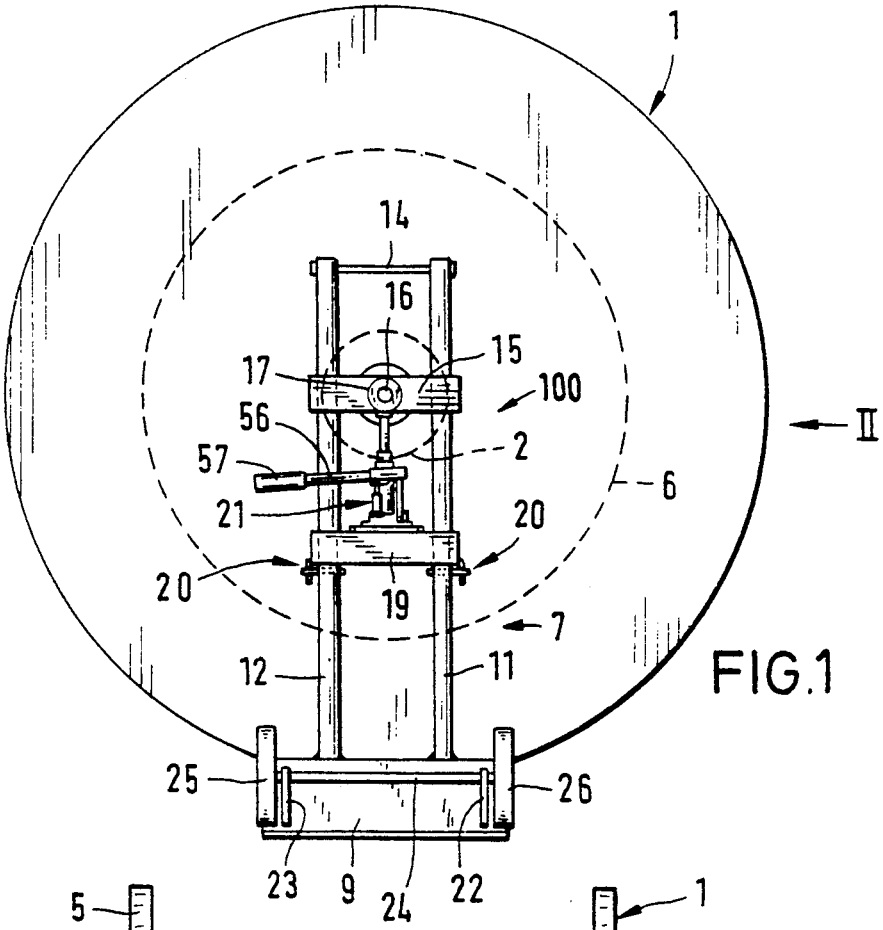
FIG. 1 is an end elevational view taken generally along line I of FIG. 2, and illustrates the mechanism of the present invention for lifting and lowering a cable drum with the cable drum being shown in its raised position.
Figure 2:
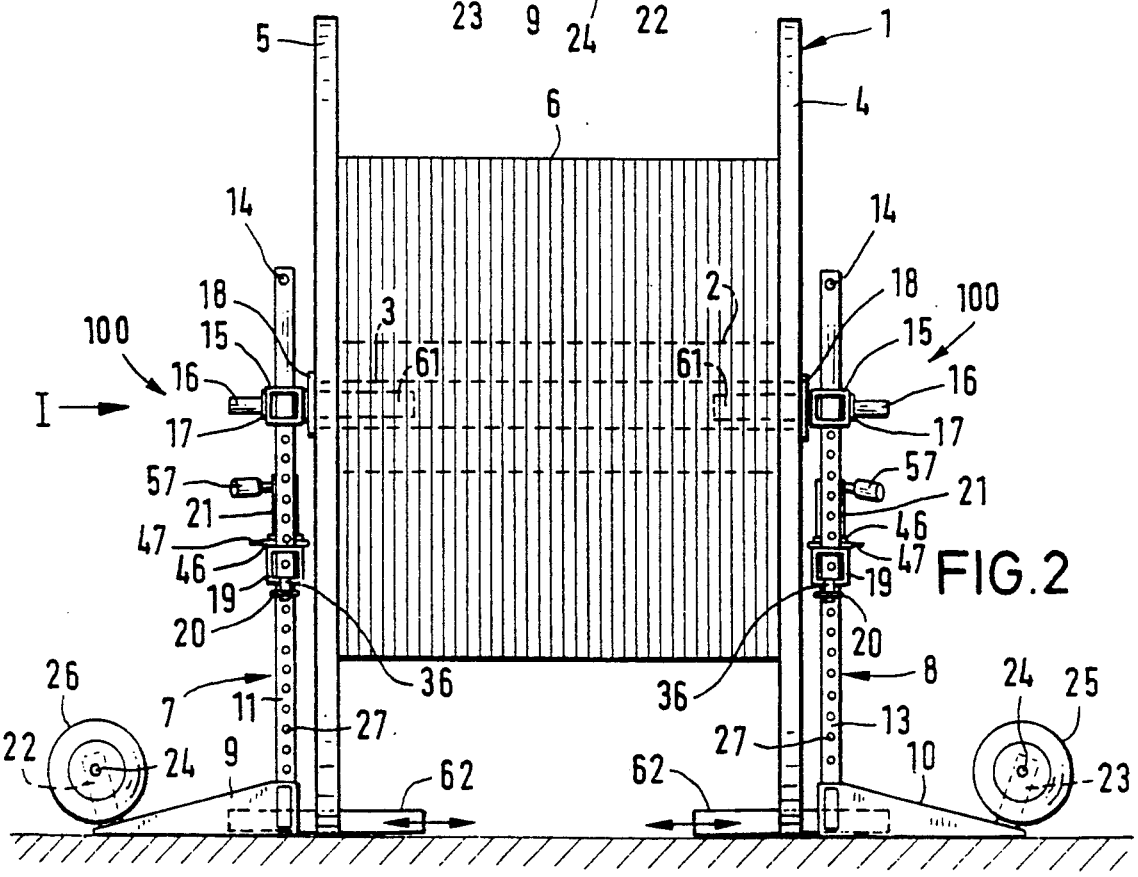
FIG. 2 is a side elevational view taken generally along line II of FIG. 1, and illustrates the cable drum in its lowered position.

A novel apparatus, mechanism or equipment constructed in accordance with this invention for lifting and lowering a cable drum relative to a support surface is illustrated in FIGS. 1 and 2 of the drawings and is generally designated by the reference numeral 100.

The cable drum 1 and is of a conventional construction including a cylindrical drum, hub on shell 2 carried by a central pipe 3, which functions as an axle, and two lateral generally parallel circular end flanges 4, 5. Cable, cord or similar material of indeterminate length is wound upon the drum 2 into a coil 6 between the flanges 4, 5. Obviously, depending upon the type of cable wound upon the drum 2, the diameter of the cylindrical hub 2 may be made smaller or larger than that illustrated in the drawings.

The mechanism 1 includes two generally identical stands 7, 8 positioned outboard of and adjacent to the respective flanges 5, 4 of the cable drum 1. Each stand 7, 8 includes a foot 9, 10, respectively, and posts rising upwardly therefrom. The stand 7 (FIGS. 1 and 3) includes the posts 11, 12 rising upwardly from the foot 9, whereas the stand 8 includes posts 12 (not illustrated) and 13 (FIG. 2) rising upwardly from the foot 10 (FIG. 2). The posts 11, 12 and 12, 13 of the respective stands 7, 8 carry upper and lower relatively adjustable crossbeams 15, 19. Each upper crossbeam 15 carries a journal or pivot pin 16 which projects into the hollow shaft 3 of the hub 2 of the cable drum 1, as is best illustrated in FIG. 2. Each lower crossbeam 19 includes an adjustment and snap-in system or mechanism 20 which will be described more fully hereinafter. A hydraulic hoist 21 is mounted between the cross-beams 15, 19 of each of the stands 7, 8.

As is best illustrated FIGS. 1 and 2, wheel rests 22, 23 are carried by each respective foot 9, 10 of the respective stands 8, 9. The wheel rests 22, 23 are angled upwardly and outwardly, as viewed in FIG. 2, and are welded as close as possible to the ends of the feet 9, 10 remote from the cable drum 1. A shaft 24 (FIGS. 1 and 2) spans and is supported by the wheel rests 22, 23 and each end carries wheels 25, 26. The design of the feet 9, 10 and the associated wheels 25, 26 is such that when the stand 7 or 8 is tipped, the wheels 25 and 26 will rests on the ground and can roll therealong. In order to improve the operation and stability of the stands 7, 8, when the same are being moved or rolled upon the ground or when in use to lift or lower the cable drum 1, the posts 11, 12 are rigidly connected at upper ends thereof by a connecting bar 14. The connecting bar 14 facilitates the tipping of the stands 7, 8 by allowing the connecting bar 14 to be gripped to pivot the stands 7, 8 as need be. For example, the stand 7, as shown in FIG. 2, can be tipped by gripping the bar 14 and pulling the same to the left to basically pivot the stand 7 counterclockwise from the position shown in FIG. 2 until the wheels 25, 26 contact the ground for transportation purposes. During this pivoting motion, the stand 7 will rotate about the outer edge (unnumbered) of the foot 9 until the two wheels 25, 26 rests on the ground. In this oblique position, the center of gravity of the stand 7 is above the two wheels 25, 26 and the stand 7 (as well as the stand 8) can be thereby easily moved.

The two posts 11, 12; 12, 13 associated with the respective stands 7, 8 are cylindrical metallic pipes having a plurality of vertical pairs of perforations 27 disposed therealong which form part of the adjustment and snap-in system 20. The perforations or openings 27 are designed to stepwise match the particular size of the cable drum 1 which is to be associated with the equipment 100. The crossbeams 15, 19 are square channels provided at their ends (unnumbered) with vertical bore holes through which pass the posts 11, 12; 12, 13. The bore holes of the upper crossbeam 15 receive bushings 28, 29; 30, 31 (FIG. 3) which embrace the posts 12, 11, respectively, to provide minimum sliding friction therebetween. The bore holes (unnumbered) of each of the lower crossbeams 19 receive bushings 32, 33; 34, 35 which also provide minimum friction guidance for the associated posts 11, 12, and 13. The horizontal journal or pivot pin 16 (FIGS. 1 through 3) is carried by each of the upper crossbeams 15 and is designed to coaxially enter a journal 61 at each axial end of the central pipe 3 of the cable drum 1. Each horizontal pin 16 is welded to a reinforcing ring 17 which is in turn welded to the upper crossbeam of each stand 7, 8 to rigidify each pin 16 so that it might serve as a rigid point of support and rotation when received in opposite journals 61 of the cable drum 1 during lifting, lowering and rotation operations thereof. A stop ring 18 is fixed to the inside of each upper crossbeam 15 and abuts the end faces (unnumbered) of the flanges 4, 5 to limit the extent each horizontal pin 16 will enter its respective journal 61. When the stop rings 18, 18 contact the respective faces of the flanges 4, 5 (FIG. 2), one merely has to observe the latter to ensure that the stands 7, 8 are in proper position relative to the cable drum 1 for lifting, lowering and/or rotation functions.

A small plate 46 (FIG. 3) is fastened by screws 48 between an upper wall (unnumbered) of each lower crossbeam 19 and its associated hydraulic hoist 21. Each small plate 46 includes an externally projecting bail or handle 47 which facilitates manual displacement of the crossbeams 15, 19 vertically upwardly and/or downwardly relative to the posts 11, 12 and 13 to match the stands 7, 8 for the particular size cable drum i which is to be utilized in conjunction with the mechanism 100. In other words, for relatively large cable drums the crossbars 15, 19 would be located relatively high or closely adjacent the connecting members 14; whereas for cable drums 1 of smaller diameters, the crossbeams 15, 19 would be appreciably lower. Essentially, each crossbeam 15 is so positioned that its pivot pin 16 is readily inserted into an associated journal 61 of the cable drum 1 when the flanges 4, 5 of the cable drum 1 are resting upon the ground, as shown in FIG. 2.

Each hydraulic hoist 21 comprises a housing 49 having a reservoir containing hydraulic fluid, such as oil, a hydraulic pump 51, a hydraulic cylinder 50, a hydraulic piston 58 and a piston rod 59. A claw 60 is mounted on an upper end (unnumbered) of each piston rod 59 and rests or is forced against a lower wall (unnumbered) of each upper crossbeam 15. The hydraulic pump 51 of each hydraulic hoist 21 is actuated by a lever arm 56 having an external handle 57. The lever arm 56 is pivoted in a vertical plane in conjunction with a support 54 and pivot pins or joints 52, 53 and 55 (FIG. 3). Valves associated with the hydraulic hoist 21 are not shown but, obviously, these can be manipulated to pressurize the hydraulic cylinder 50 to extend the piston rod 59 therefrom or operate vice versa.

Reference is made to FIGS. 3 and 3A which illustrate the adjustment and snap-in system 20 of the present invention in the form of a bolt or pin 37 which is slipped into the aligned perforations or openings 27 of the posts 11, 12; 12, 13. Each pin or bolt 37 includes an eyelet 38 at its outer end (unnumbered) with each eyelet 38 being engaged from above by a stud or flange 36 carried by each lowered crossbeam 19 (FIG. 3). When located in the manner shown in FIGS. 3 and 3A, the pins 37 cannot be removed from the perforations 27 and the crossbeams 19 are suitably supported and retained thereby in any selected position of adjustment relative to the posts 11, 12 and 13.

Another adjustment and snap-in system is shown in FIGS. 4 and 4A of the drawings, and in this case a small box housing 39 is welded to a lower wall (unnumbered) at each end of each crossbeam 19. A bolt 40 having a bail or handle 41 is slidable mounted in each housing and carries a stop ring 42 against which a compression spring 43 reacts to normally bias each bolt 40 toward its associated post 11, 12 or 13 and the perforations 27 thereof. The compression spring 43 associated with each bolt 40 thereby automatically urges each bolt 40 into its associated perforation 27, though removal of the latter is readily achieved by merely gripping the handle or bail 41 and pulling the bolt 40 against the bias of the compression spring 43.

OPERATION

Because of the comparative low weight and compactness of each stand 7, 8, each stand can be readily moved manually or by any vehicle to a desired site. If the stands 7, 8 are resting upon the bed of a vehicle and are delivered to a site at which is located the cable drum 1, a person can manually tilt each of the stands 7, 8 to bring the wheels 25, 26 into rolling contact with the vehicle bed, as was heretofore described. Such person can then readily roll the stands 7, 8 adjacent the cable drum 1 at the desired site, and each stand 7, 8 can be positioned adjacent the respective flanges 5, 4, similar to the position shown in FIG. 2 but, obviously, spaced therefrom. The crossbeams 15, 19 and the hydraulic hoist 21 can then be manually moved to a desired height on the respective posts 11, 12 and 13, such that the pivot pins 16 are aligned with and can be inserted into the journals 61 of the particular cable drum 1 which is to be utilized. When thus aligned, the stands 7, 8 are moved toward the respective flanges 5, 4 until the pivot pins 16 enter the journal 61 and the mechanism 100 is now associated with the cable drum 1 in the manner shown in FIG. 2 with, of course, the flanges 4, 5 resting upon the ground. The hydraulic piston rod 58 of each hydraulic hoist 21 is in its retracted position and each lower crossbeam 19 is then vertically slid along its associated posts 11, 12 and 13 until a position is reached at which the claw 60 is moved upward as much as possible and is contiguous the lower wall (unnumbered) of the lower crossbeam 19. At this point the pins 37 are inserted into the perforations 27 and the lower crossbeams 19 are lowered slightly until the flanges or stubs 36 enter the handles or bails 38 (FIG. 3A). Each handle 56 is then manipulated to bring each claw 60 into contact with each lower crossbeam 19 and progressively raise each upper crossbeam 15 and its pin 16 upwardly. Obviously, the pins 16 act through the journals 61 to raise the cable drum 1 off the ground (FIG. 1) and permit the coil 6 to be unwound therefrom. Obviously, the cable or rope can also be wound upon the cable drum 1, if desired, and the reverse sequence just described is utilized to lower and remove the stands 7, 8 relative to the cable drum 1.

In further accordance with the present invention, each of the feet 9, 10 are preferably formed as a triangular box section tapering outwardly and parallel to the plane of FIG. 2. This construction achieves high mechanical strength at relatively low weight and minimum material. Advantageously, each foot 9, 10 may also be provided with sliding foot rests 62 which can be slipped beneath the flanges 4, 5 of the cable drum 1 after the latter has been lifted from the ground. The foot rests 62 are preferably held in horizontal guides (not shown) in each of the feet 9, 10. The foot rests 62, obviously, provide a larger base and, therefore, greater stability to the stands 7, 8. In lieu of the sliding connection of the foot rests 62 relative to the feet 9, 10, the same may be pivoted to the feet 9, 10 in a conventional manner by, for example, pivot bolts mounted by suitable fasteners to the outside of the feet 9, 10 at the level of the lower ends of the posts 11, 12 and 13. In this manner, the foot rests 62 can be pivoted through approximately 180° from a rest position into an operational position beneath the flanges 4, 5 of the cable drum 1.

Although a preferred embodiment of the invention has been specifically illustrated and described herein, it is to be understood that minor variations may be made in the apparatus without departing from the spirit and scope of the invention, as defined in the appended claims.

I claim:

1. A mechanism for lifting a cable drum comprising a pair of stands between which a cable drum is adapted to be positioned, each stand includes a foot and a pair of tubular cylindrical posts, an upper hollow polygonal crossbeam and a lower hollow polygonal crossbeam, said upper and lower crossbeams each having a hole in opposite end portions thereof slidably receiving an associated pair of posts, each upper crossbeam carrying a support pin adapted to enter a journal of an associated cable drum, means for selectively adjusting the position of each lower crossbeam relative to its pair of posts, a hydraulic hoist disposed between each upper and lower crossbeam for raising and lowering the upper crossbeam, its support pin and the associated cable drum, each foot having a first end portion adjacent its associated posts and a second end portion remote therefrom, wheels carried by said foot second end portions whereby said stands can be individually tilted and transported by said wheels rolling along an associated supporting surface, and each hydraulic hoist includes a piston rod engageable against a lower wall of its associated upper crossbeam.

2. The cable drum lifting mechanism as defined in claim 1 wherein said pair of posts includes a plurality of vertically spaced perforations in at least one post of each pair of posts, and said selective adjusting means is in part defined by said perforations.

3. The cable drum lifting mechanism as defined in claim 1 including a plurality of bushings fixed in bores of said upper and lower crossbeams, and said posts are in sliding relationship with said bushings.

4. The cable drum lifting mechanism as defined in claim 1 wherein each foot is a hollow triangular box having a cross-section tapering away from its associated posts.

5. The cable drum lifting mechanism as defined in claim 1 including a foot rest associated with each foot, and each foot rest being constructed and arranged for movement between a non-use position and a use position in which the effective length of each foot is increased.

6. The cable drum lifting mechanism as defined in claim 1 wherein each hydraulic hoist is carried by a plate fastened to its associated lower crossbeam, and one of each plate carry a handle for facilitating vertical sliding movement of each lower crossbeam relative to its pair of posts.

7. The cable drum lifting mechanism as defined in claim 1 including a connecting bar connecting together each pair of posts remote from the associated foot thereof.

8. The cable drum lifting mechanisms as defined in claim 1 wherein said selective adjusting means includes a plurality of vertically spaced perforations in at least one post of each pair of posts, an adjustment pin adapted for insertion into selected ones of said perforations, and each adjustment pin being in underlying supporting relationship to its associated lower crossbeam.

9. The cable drum lifting mechanism as defined in claim 8 including a foot rest associated with each foot, and each foot rest being constructed and arranged for movement between a non-use position and a use position in which the effective length of each foot is increased.

10. The cable drum lifting mechanisms as defined in claim 1 wherein said selective adjusting means includes a plurality of vertically spaced perforations in at least one post of each pair of posts, an adjustment pin adapted for insertion into selected ones of said perforations, each adjustment pin being in underlying supporting relationship to its associated lower crossbeam, each adjustment pin having an opening, and each lower crossbeam carries a stud received in its associated adjustment pin opening to prevent inadvertent removal of the adjustment pin relative to its associated perforation.

11. The cable drum lifting mechanisms as defined in claim 1 wherein said selective adjusting means includes a plurality of vertically spaced perforations in at least one post of each pair of posts, an adjustment pin adapted for insertion into selected ones of said perforations, each adjustment pin being in underlying supporting relationship to its associated lower crossbeam, and each adjustment pin being biased by biasing means in a generally lateral direction into an associated perforation.

12. The cable drum lifting mechanisms as defined in claim 1 wherein said selective adjusting means includes a plurality of vertically spaced perforations in at least one post of each pair of posts, an adjustment pin adapted for insertion into selected ones of said perforations, each adjustment pin being in underlying supporting relationship to its associated lower crossbeam, each adjustment pin being biased by biasing means in a generally lateral direction into an associated perforation, and each adjustment pin having a handle for gripping and pulling the adjustment pin against the force of its associated biasing means.

13. The cable drum lifting mechanisms as defined in claim 1 wherein said selective adjusting means includes a plurality of vertically spaced perforations in at least one post of each pair of posts, an adjustment pin adapted for insertion into selected ones of said perforations, and each adjustment pin being in underlying supporting relationship to its associated lower crossbeam.

14. The cable drum lifting mechanisms as defined in claim 1 wherein said selective adjusting means includes a plurality of vertically spaced perforations in at least one post of each pair of posts, an adjustment pin adapted for insertion into selected ones of said perforations, each adjustment pin being in underlying supporting relationship to its associated lower crossbeam, each adjustment pin having an opening, and each lower crossbeam carries a stud received in its associated adjustment pin opening to prevent inadvertent removal of the adjustment pin relative to its associated perforation.

15. The cable drum lifting mechanisms as defined in claim 1 wherein said selective adjusting means includes a plurality of vertically spaced perforations in at least one post of each pair of posts, an adjustment pin adapted for insertion into selected ones of said perforations, each adjustment pin being in underlying supporting relationship to its associated lower crossbeam, and each adjustment pin being biased by biasing means in a generally lateral direction into an associated perforation.

16. The cable drum lifting mechanisms as defined in claim 1 wherein said selective adjusting means includes a plurality of vertically spaced perforations in at least one post of each pair of posts, an adjustment pin adapted for insertion into selected ones of said perforations, each adjustment pin being in underlying supporting relationship to its associated lower crossbeam, each adjustment pin being biased by biasing means in a generally lateral direction into an associated perforation, and each adjustment pin having a handle for gripping and pulling the adjustment pin against the force of its associated biasing means.

* * * * *